US010315209B2

(12) United States Patent
Presche

(10) Patent No.: US 10,315,209 B2
(45) Date of Patent: Jun. 11, 2019

(54) DISPENSER IN PARTICULAR FOR LIQUID TO PASTY SUBSTANCES

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/766,058

(22) PCT Filed: Oct. 4, 2016

(86) PCT No.: PCT/EP2016/073648

§ 371 (c)(1),
(2) Date: Apr. 5, 2018

(87) PCT Pub. No.: WO2017/060227

PCT Pub. Date: Apr. 13, 2017

(65) Prior Publication Data

US 2018/0318863 A1 Nov. 8, 2018

(30) Foreign Application Priority Data

Oct. 7, 2015 (DE) ..... 10 2015 117 127
Apr. 1, 2016 (DE) ..... 10 2016 106 017

(51) Int. Cl.
*B05B 11/00* (2006.01)

(52) U.S. Cl.
CPC ..... *B05B 11/3028* (2013.01); *B05B 11/0044* (2018.08); *B05B 11/306* (2013.01);
(Continued)

(58) Field of Classification Search
CPC ..... B05B 11/2038; B05B 11/306; B05B 11/3074; B05B 11/3077; B05B 11/2028; B05B 11/0044; B05B 11/00412
(Continued)

(56) References Cited

U.S. PATENT DOCUMENTS 3,889,628 A 6/1975 Usab
4,201,317 A 5/1980 Aleff
(Continued)

FOREIGN PATENT DOCUMENTS

EP 0 864 371 A1 9/1998
JP 3566817 B2 9/2004
(Continued)

OTHER PUBLICATIONS

International Search Report of PCT/EP2016/073648, dated Apr. 4, 2017.
(Continued)

*Primary Examiner* — Lien M Ngo
(74) *Attorney, Agent, or Firm* — Collard & Roe, P.C.

(57) ABSTRACT

A dispenser for liquid to pasty substances, has a pumping chamber that has a top pumping chamber wall and a bottom pumping chamber wall in relation to a vertical pumping movement; the bottom and top pumping chamber walls extend from laterally inside to laterally outside in relation to a geometrical axis running vertically through the center of the pumping chamber. In order to advantageously improve a dispenser of the aforementioned type, the bottom pumping chamber wall is joined to the top pumping chamber wall by designing the two walls as a single piece, or by welding or gluing the two walls together, and when the dispenser is actuated, the bottom pumping chamber wall deforms by folding inward such that an elevated region is formed inside in the lateral direction and a lowered region is formed outside in the lateral direction in order for substance to be dispensed.

9 Claims, 5 Drawing Sheets

(52) U.S. Cl.
CPC ..... *B05B 11/3074* (2013.01); *B05B 11/3077* (2013.01); *B05B 11/00412* (2018.08)

(58) Field of Classification Search
USPC .... 222/321.1, 321.2, 321.7–321.9, 632, 633, 222/207, 209, 211–215
See application file for complete search history.

(56) References Cited

U.S. PATENT DOCUMENTS 4,728,009 A 3/1988 Schmidt
5,351,863 A 10/1994 Cecil et al.
5,544,789 A * 8/1996 Gillingham ..... B05B 11/3033 222/153.13
5,819,990 A * 10/1998 Cimentepe ..... B05B 11/0067 222/207
6,279,784 B1 * 8/2001 O'Neill ..... B05B 11/303 222/207
6,669,056 B2 * 12/2003 Bistolfi ..... B05B 7/0037 222/145.1
6,755,327 B1 * 6/2004 Hazard ..... B05B 11/3035 222/209
7,063,235 B2 * 6/2006 Auer ..... B05B 11/0064 222/135
7,677,415 B2 * 3/2010 Auer ..... B05B 11/3035 222/207
7,819,290 B2 * 10/2010 Behar ..... B05B 11/3033 222/207
8,225,966 B2 7/2012 Canfield et al.
8,474,661 B2 * 7/2013 Carta ..... B05B 11/3028 222/153.13
2005/0011913 A1 1/2005 Foster et al.
2006/0163286 A1 * 7/2006 Neerincx ..... B05B 11/303 222/207
2014/0239017 A1 * 8/2014 Von Schuckmann ..... B05B 11/3033 222/207

FOREIGN PATENT DOCUMENTS

WO 85/02563 A1 6/1985
WO 2004/016517 A1 2/2004
WO 2006/031110 A1 3/2006
WO 2007/104561 A2 9/2007
WO 2012/168916 A2 12/2012

OTHER PUBLICATIONS

Response to European Patent Office by German Patent Attorney regarding PCT/EP2016/073648 dated Jul. 31, 2017 with English translation of relevant parts.

* cited by examiner

DISPENSER IN PARTICULAR FOR LIQUID TO PASTY SUBSTANCES

CROSS REFERENCE TO RELATED APPLICATIONS

This application is the National Stage of PCT/EP2016/073648. filed on Oct. 4, 2016, which claims priority under 35 U.S.C. § 119 of German Application No. 10 2015 117 127.9 filed on Oct. 7, 2015 and German Application No. 10 2016 106 017.8 filed on Apr. 1, 2016, the disclosures of which are incorporated by reference. The international application under PCT article 21(2) was not published in English.

FIELD OF THE ART

The invention initially relates to a dispenser, in particular, for liquid to pasty substances, comprising a pumping chamber that has a top pumping chamber wall and a bottom pumping chamber wall in relation to a pumping movement when the dispenser is handled normally, i.e. during a vertical pumping movement; the bottom and top pumping chamber walls extend from laterally inside to laterally outside in relation to a geometrical axis running vertically through the center the pumping chamber.

PRIOR ART

Dispensers of the kind in question are known. These are used, for example, to distribute lotions and cremes.

From U.S. Pat. No. 3,889,628 A, dispenser is known where a top and a bottom pumping chamber wall is provided, wherein, furthermore, also the bottom pumping chamber wall can be folded inward and can form an inner higher and outer lower area in the lateral direction. The return valve is formed in an extension of the top pumping chamber wall extending into the pumping chamber. From WO 2007/104561 A2, a dispenser is known with a top pumping chamber wall which is designed with several layers. The bottom pumping chamber wall is designed as a solid injection-moulded part.

Furthermore, concerning the most recent background art, reference is made to US 2005/0011913 A1. In the case of a displacement of the dispenser head in the direction of the storage space, thereby, the pumping chamber is readily made smaller.

SUMMARY OF THE INVENTION

Based on the most recent background art shown, the invention deals with the task of indicating a favourable dispenser.

This task is initially solved by a dispenser having a top pumping chamber wall with a pipe section extending into the pumping chamber in an extension of a discharge channel against a discharge direction of the substance. The diameter of this pipe section is adapted to an inner diameter of a bottom tubular section of the bottom pumping chamber wall so that, between the bottom pumping chamber wall and the pipe section, an annulus that is open in the direction of the inlet valve or storage space or is set during the course of a pumping operation.

The bottom pumping chamber wall has an EVOH layer and that it is barrier-injection-moulded.

With an axial displacement of the dispenser head in the direction of the storage space, the pumping chamber is initially carried along with in an uninfluenced manner until a position is reached, in which a piston snap-mounted into position on the bottom pumping chamber wall limited by an end-stop assumes an end position, in which the ventilation opening is released.

A reduction of the pumping chamber volume can be achieved alone or in combination with other measures by folding a pumping chamber wall inward, in particular, the bottom pumping chamber wall. In particular, folding inward takes place subsequent to a drag entrainment during the course of the pumping movement of at least one of the pumping chamber walls, preferably of the top pumping chamber wall will the other, in particular, the bottom pumping chamber wall experiences a smaller axial displacement in a preferably lateral inner area than the top pumping chamber wall.

From this, in the case of a pumping movement to discharge the medium, a significant reduction of the pumping chamber volume can result in the lateral inner area of the pumping chamber.

The connection of the bottom pumping chamber wall to the top pumping chamber wall can be given, as is also preferred, in a lateral outer area of the bottom pumping chamber wall. In the case of a pumping movement, the bottom pumping chamber wall in the lateral outer area can be displaced over an axially greater path via this connection than in the lateral inner area, which results in a corresponding partial folding in of the bottom pumping chamber wall if applicable.

The pumping chamber, also referred to is the top and/or bottom pumping chamber wall in the following, can be designed to be rotationally symmetric to the geometrical axis of the dispenser. In this case, the lateral direction results in being a radial direction.

A surface of the bottom pumping chamber wall, preferably the surface directed into the inner interior space of the pumping chamber of the bottom pumping chamber wall, can be jagged by means of preformed projections and depressions. From this, a specified folding in of the bottom pumping chamber wall can result in the case of actuating the pump.

The pumping chamber walls can be made of a plastic material with a high degree of barrier density, also with regard to the top pumping chamber wall, being made of multiple layers for example. In addition to an EVOH layer, the pumping chamber walls can have a coating, for example, a silicon oxide or silicon dioxide coating and/or, in the case of a design with multiple layers, if applicable, only with regard to one or a plurality of layers, consisting of a material such as PET, PBT or PA.

A dispenser is indicated as a result of the suggested embodiment, which is designed with a dense barrier that is sealed against oxygen at least in the area of the pumping chamber and furthermore or as an alternative, has a dense barrier that is also sealed against water vapour and/or UV light for example.

The depressed position can, as is preferred, be the substance discharge position. Accordingly, the ventilation of the space storing the substance preferably takes place during the course of discharging the substance from the pumping chamber. For this purpose, a closure element carried along during the course of a pumping movement is provided, namely the piston, which alternately opens and closes the ventilation opening. In addition, during the course of the pumping movement, a closure element, for example a flap, can be displaced into a position closing the ventilation opening and back again directly or indirectly by means of a displaceable dispenser head, for example, being pivotally displaced.

In another embodiment, the closure element can be spring-loaded into a position, for example, into the ventilation-opening open position, whereby a separate spring is provided or the spring force (alone) results from the closure element material (e.g. in the case of manufacturing the closure element from a plastic material with good elastic recovery).

The pump chamber can have an inlet and outlet valve. These open and close depending on the pressure at hand, preferably alternating during the course of the pumping movement.

In the case of deformation, the bottom pumping chamber wall can also develop its own elastic restoring force. This restoring force alone can result from the wall material and also be supported by the jaggedness of the surface of the bottom pumping chamber wall. The jaggedness can initially result from a level running transversely to the housing axis by means of projections and recesses. The restoring force acts in the direction of the raised position of the dispenser head, thereby preferably being the direction of a starting position of the pumping chamber, in which this reaches a maximum volume.

If applicable, a spring pre-tensioning the bottom pumping chamber wall into an initial position can additionally be provided. Hereby, it can be made of a plastic material, for example, manufactured by means of a plastic-injection-moulding method.

Furthermore, the spring can be held separately within the dispenser. As an alternative, the spring, in particular when manufactured from a plastic material, can be moulded on a subsection of the dispenser or be designed with it as a single piece, in particular, on a dispenser section, which cannot be displaced the course of a pumping operation.

The inlet and/or outlet valve can be manufactured using a second plastic material and preferably be manufactured by means of a two-component injection-moulding method. For example, the valve can be moulded into parts of the dispenser head within the scope of a two-component injection-moulding method.

In an embodiment, the inlet and/or outlet valve can be accommodated in a form-fitting manner within an area made via a first plastic material. In this way, furthermore, the inlet valve can be moulded within the area of the bottom pumping chamber wall and the outlet valve can be moulded within the area of the top pumping chamber wall, here within the area of the openings for the substance to flow into the pumping chamber, as well as to discharge the substance from the pumping chamber respectively.

The bottom pumping chamber wall can have a topside and a bottom-side tubular section, wherein the bottom-side tubular section has a lateral extension in a longitudinal cross-section, which is a tenth less or more than a tenth less, all the way to a seventh less than the lateral extension of the top side tubular section. In the case of a rotationally symmetric embodiment of the pumping chamber, in this way, the diameter of a bottom-side tubular section can correspond, for example, to 3/10 all the way to 9/10 of the diameter of the top side tubular section for example.

The outlet valve can also be inserted and held, for example, within the area of the discharge pipe by means of friction alone. In the case of arranging a follower piston within the storage container, only one outlet valve can be provided.

In a preferred embodiment, the tubular sections overlap into each other via a folding section, which primarily only extends laterally. The folding section, in a starting position of the bottom pumping chamber wall, where the initial position is preferably reached in the raised position of the dispenser head, can primarily extend into the radial direction (with reference to a longitudinal cross-section of the dispenser), meaning at a level transverse to the axis described above.

In any case, the bottom tubular section can be cylinder-shaped. The top tubular section can also be designed in this manner.

The top pumping chamber wall can have a pipe section extending into the pumping chamber against the direction of the substance's discharge. This diameter of this pipe section can be adapted to an inner diameter of the bottom tubular section of the bottom pumping chamber wall.

In this way, between the bottom pumping chamber wall and the pipe section, an annulus can be formed that is open in the direction of the inlet valve or the storage space or be set during the course of the pumping operation.

By means of the pumping movement between a raised and a depressed position, a ventilation opening of the storage space can be opened or closed. Preferably, the ventilation opening is open in the depressed position, where the depressed position preferably corresponds to the substance discharge position. The ventilation opening provides for a pressure compensation, in particular, between the substance storage space and the ambient environment.

In this way, a closure element can be provided for the ventilation opening. This can be motion-coupled to the bottom pumping chamber wall and/or a holder area of the inlet valve. The closure element can be carried along in this manner during the course of a pumping movement, at least across part of the path. The movement of the closure element can take place along the geometrical dispenser axis.

The inlet valve and/or a holder area for the inlet valve can be moved during the course of a pumping movement, thereby, in particular, being between a depressed and a raised position.

In a preferred embodiment, the closure element can be a piston having one or a plurality of circumferential sealing lips. Thereby, the sealing lips are preferably used to seal the storage space against the ambient environment in a pump position, in particular, in the raised position. The sealing lips preferably interact with non-displaceable areas of the dispenser.

The piston preferably made of a rubber or TPE material forming the closure element can be mounted to a bottom pumping chamber wall, preferably to its bottom tubular section on the outside, for example being snap-mounted. An axial shifted the entire pumping chamber and thereby also at least of the central bottom tubular section of the bottom pumping chamber wall leads to carrying along the piston accordingly, preferably into the ventilation position of the storage space or into the ventilation opening/closure position.

In addition, the dispenser can have a pan-like holder, in which the pumping chamber is accommodated. The pan opening of the holder can, as is preferred, be orientated toward the usual actuation direction of the dispenser head.

The piston can lead the bottom pumping chamber wall, in particular, as a result of the piston with the bottom tubular section of the bottom pumping chamber wall snapping in the holder in an axial direction, furthermore, also in the transverse direction to this if applicable.

The ranges and values ranges or multiple ranges described in the above and in the following also include all intermediate values with regard to the disclosure, in particular in one-tenth steps of the respective dimensions, if applicable, also without dimensions. For example, the indication of on tenth to seven tenths also includes the disclosure of eleven hundredths to seven tenths, one tenth to sixty-nine hundredths, eleven hundredths to sixty-nine hundredths, etc. On the one hand, the disclosure can be to limit a specified upper and/or lower range limit, as an alternative however, it can be to disclose one or a plurality of singular values from a respectively indicated range.

BRIEF DESCRIPTION OF THE DRAWINGS

In the following, the invention is described using the enclosed drawing, which however only represents exemplary embodiments. One part, which is merely described with reference to one of the exemplary embodiments and, in the case of another exemplary embodiment, is not replaced with another part due to the feature having resulted there, is therefore also described as a possibly available part in any case for this other exemplary embodiment. The figures show:

FIG. 7. The raised position of the dispenser head after carrying out a pumping movement in a cross-sectional illustration in accordance with FIG. 6;

FIG. 9: in illustration corresponding to FIG. 8, however concerning a second embodiment of the dispenser head and FIG. 10 in another illustration corresponding to FIG. 8, concerning a dispenser head in a third embodiment

DESCRIPTION OF THE EMBODIMENTS

A dispenser 1 for liquid to pasty substances in particular is shown and described.

In accordance with the embodiments shown in FIGS. 1 to 9, the dispenser 1 can be arranged on a storage container 2 with a storage space 3.

In these embodiments, the latter is directly given and limited by the container wall of the storage container 2.

Figure 10:
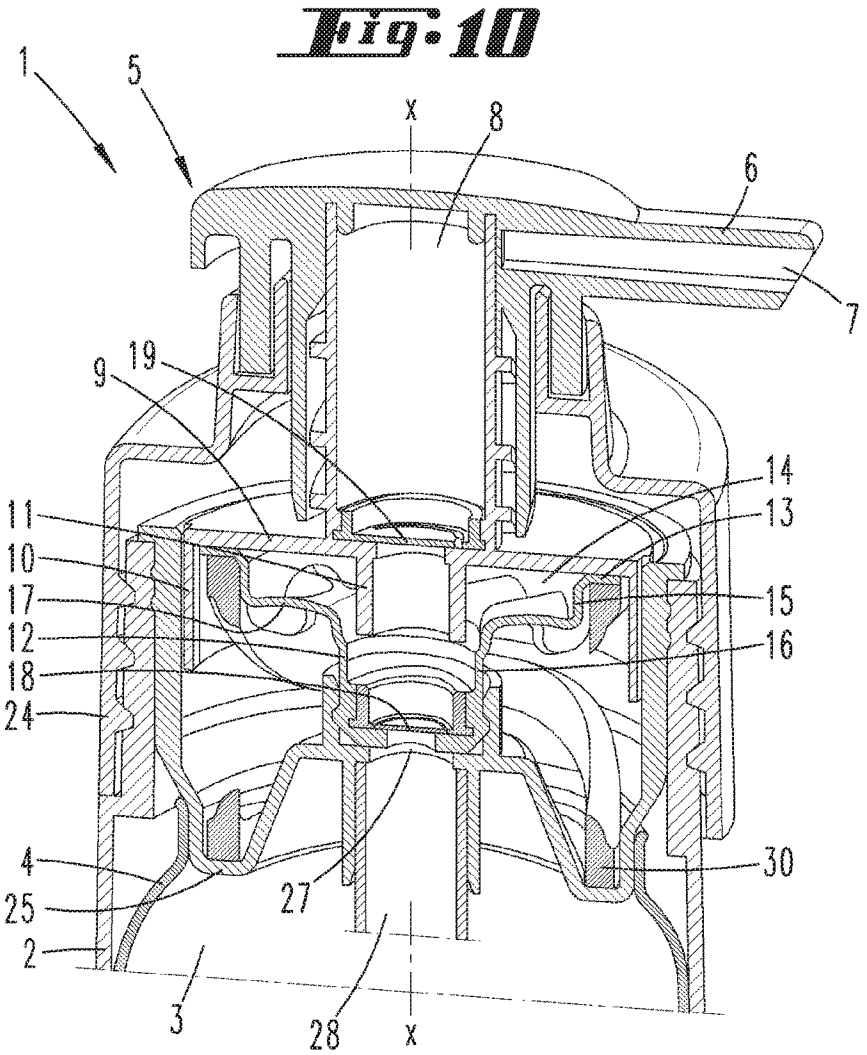

According to the illustration in FIG. 10, as an alternative, a compressible bag 4 can be provided within the storage container 2, which forms the storage space 3.

The dispenser 1 has a displaceable dispenser head 5. The displaceability is given to achieve a pumping movement along a geometrical axis x, which is vertically aligned when the dispenser 1 is handled normally and pushed through the middle of the dispenser head 5.

Primarily, the dispenser head 5, and furthermore the entire dispenser 1, is designed to be rotationally symmetric to the axis x, with the exception of a discharge nozzle 6 primarily radially orientated to the axis x with a discharge opening. 7.

Figure 3:
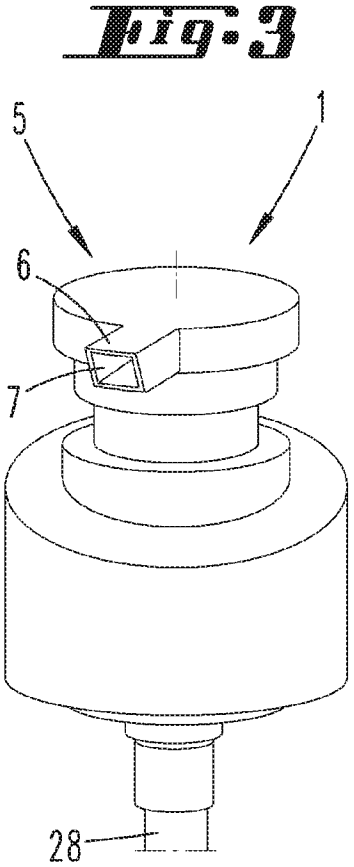
FIG. 3 an illustration corresponding to FIG. 2, concerning the unlocked use position of the dispenser head, FIG. 4 the dispenser head of the first embodiment in a longitudinal cross-section, concerning a raised position of the dispenser head.
Figure 2:
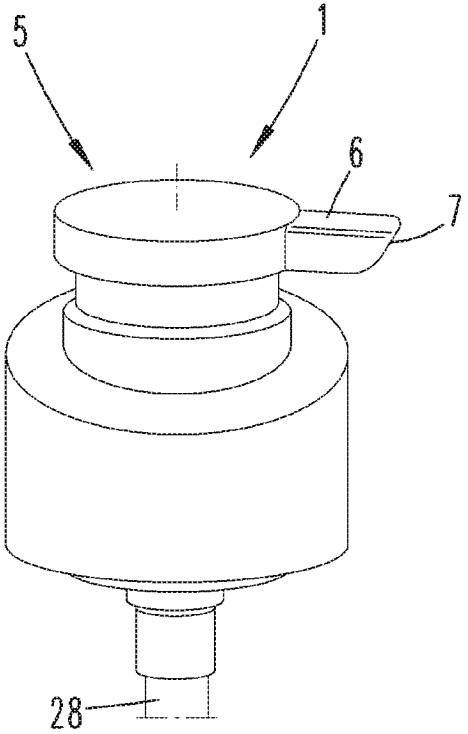
FIG. 2 the dispenser in a prospective individual illustration, concerning a locked non-use position of the dispenser head.
Figure 1:
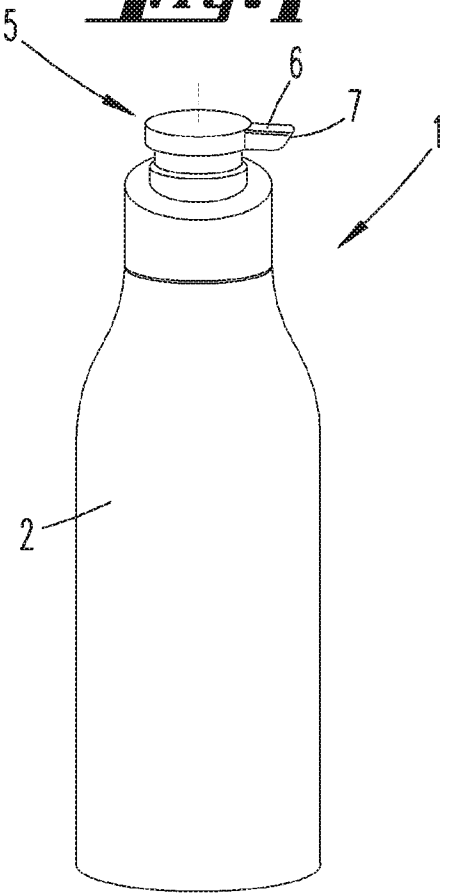
FIG. 1 a dispenser in a prospective illustration arranged on a storage container.

In accordance with the illustrations in FIGS. 2 and 3, the dispenser head 5 can be rotationally moved around the axis x from a locked position in accordance with FIG. 2, in which no pumping movement can be carried out, into a usage position in accordance with FIG. 3. From this position in accordance with FIG. 3, a pumping movement can be carried out, thereby discharging the substance by pressing down the dispenser head 5 and then moving the same back into the initial position.

A discharge channel 8 is formed within the dispenser head 5 coaxially to the axis x. On one end, this leads into the discharge nozzle 6.

Opposite to the mouth this leads into, the wall of the discharge channel 8, for example, being manufactured as a single piece and using an identical material within the scope of a plastic mould injection method or joined to top pumping chamber wall 9 via a shaped insert.

The top pumping chamber wall 9 primarily extends in a plate-shaped manner on a horizontal level in the case of a vertical alignment of the axis x.

Circumferentially along the edge of the pumping chamber wall 9, a collar 10 is formed under the top pumping chamber wall 9.

In an extension of the discharge channel 8, opposite to it, preferably with a smaller diameter, a pipe section 11 formed as a single piece with the top pumping chamber wall 9 surrounded by the collar 10 extends under the top pumping chamber wall 9.

Beneath, primarily surrounding the pipe section 11, a bottom pumping chamber wall 12 is attached to the top pumping chamber wall 9, in particular, via a radial collar 13. The bottom pumping chamber wall 12 primarily has a pan shape overall, with a centrally indented area.

Thereby, this can be a single-piece design of the top and the bottom pumping chamber wall 9, 12. Preferably, with reference to this, joining by means of welding or gluing the surfaces facing each other of the radial collar 13 and the top pumping chamber wall 9.

A pumping chamber 14 results limited by the pumping chamber walls 9 and 12.

The bottom pumping chamber wall 12 primarily consists of a topside tubular section 15 and a bottom-side tubular section 16.

The top tubular section 15 merges into the radial collar 13.

Both tubular sections 15 and 16 merge into each other via a plate-like folding section 17 primarily only extending into a radial direction to axis x (in particular, in the starting position of the dispenser head 5).

Figure 4:
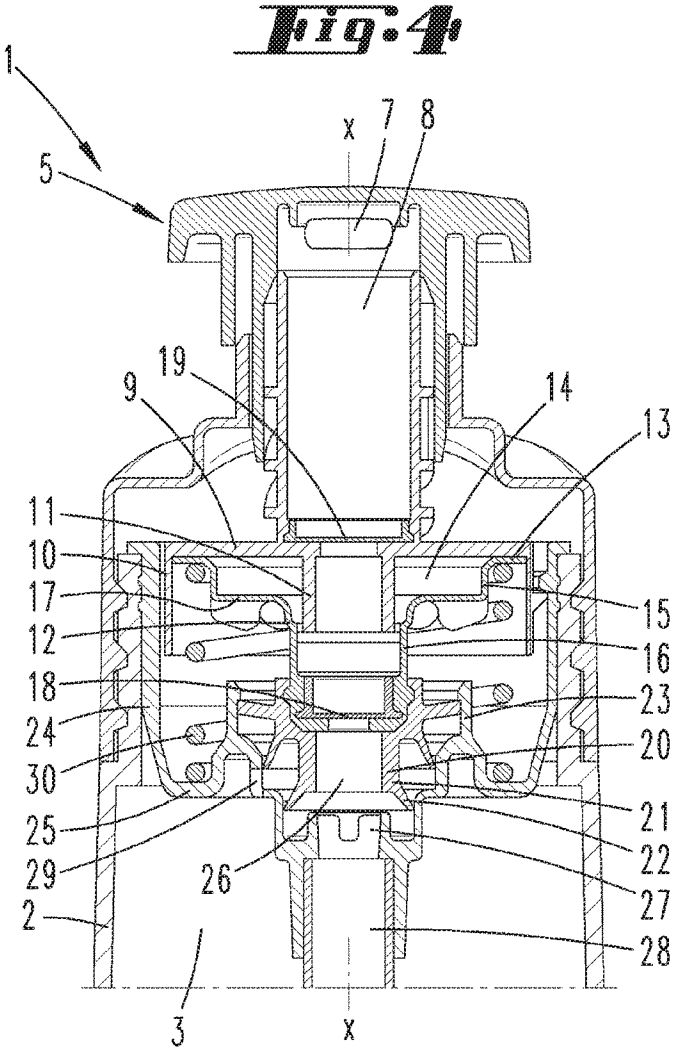
Figure 1:
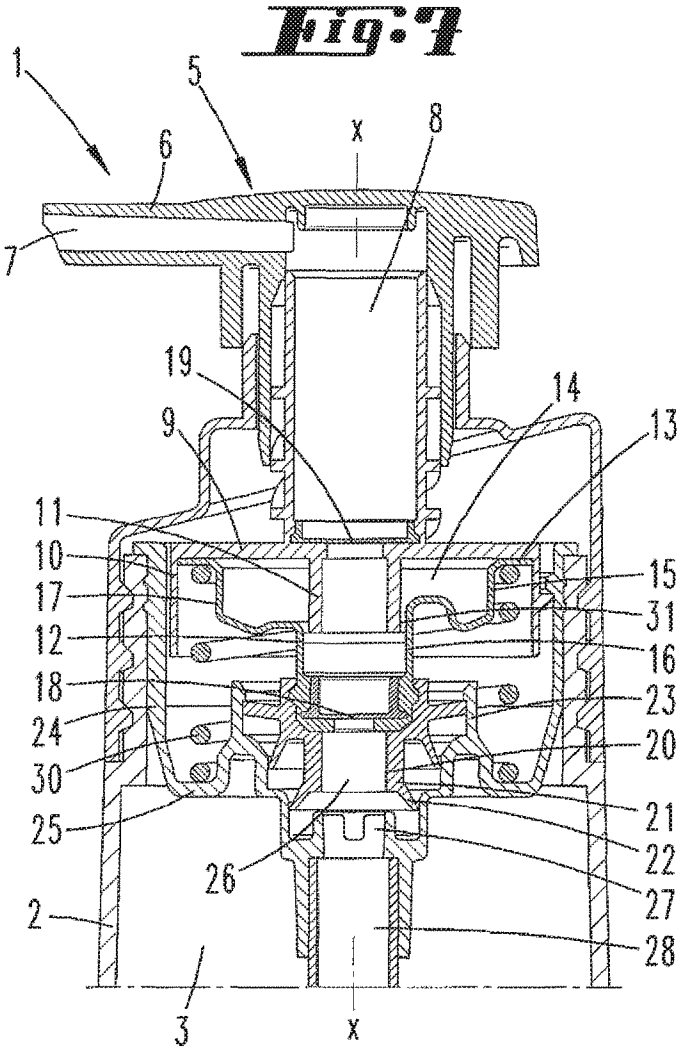

The folding section 17 is, in particular, in the unloaded starting position of the dispenser head 5 in accordance with the illustration in FIG. 4, spaced away from the top disc-like pumping chamber wall 9.

The bottom-side tubular section 16 has, in relation to the axis x, a diameter a, which corresponds to approximately a fourth to a third of the diameter b of the top tubular section 15.

In particular, the bottom tubular section 16 overall is designed to have a circular cylinder shape. The pipe section 11 can dip into this section when actuating the dispenser 1.

At the foot end of the bottom tubular section 16, an inlet valve 18 is formed. For example, this can be manufactured within the scope of a two-component injection-moulding method.

In particular, the bottom pumping chamber wall 12, furthermore, preferably also the top pumping chamber wall 9 are preferably manufactured using a plastic material with a high degree of barrier density. In this way, a multiple of layers can be provided in this respect. This can be achieved by means of barrier-injection-moulding using PP (polypropylene) or EVOH (ethylene/vinyl alcohol copolymer) or by designing the pumping chamber walls out of PET (polyethylene terephthalate) or PBT (polybutylene terephthalate) or PA (polyamide). Furthermore, a coating with silicon oxide or silicon dioxide can be provided, this also in the case of designing the wall with a multiple of layers, where, if applicable, only one or also a plurality of layers are coated in this manner.

Both the inlet valve 18 as well as an outlet valve 19 provided in the transition from the pipe section 11 into the discharge channel 8, which is preferably also manufactured within the scope of a two-component injection-moulding process, are, in particular, made of another plastic material, particularly out of another soft plastic material against the pumping chamber walls.

The foot end of the bottom tubular section 16, which faces away from the discharge channel 8, of the bottom pumping chamber wall 12 is designed to snap-lock a closure element 20 in a fixed position arranged in a outwardly in a radial manner. The closure element 20 is motion-coupled to the bottom pumping chamber wall 12 or fixed to its bottom tubular section 16.

The closure element 20 is designed as a type of piston 21 with circumferential sealing lips 22, which are axially spaced away from each other, primarily aligned outwardly in a radial manner. Both sealing lips 22 provided extend on different radii.

The piston 21 is led in a pan section 23 aligned coaxially to the axis x. The axial end positions can be defined in this area, for example, as a result of setting of piston section at corresponding protrusions of the pan section 23.

The pan section 23 is part of a holder 24. Overall, this is pan-like in shape, having a pan base 25, which, in particular, separates the storage space 3 from the dispenser head 5.

Preferably, on the pan base 25, there is an opening 27 provided, at which a suction pipe 28 can connected beneath as an axial extension to the discharge channel 8 and the pipe section 11, furthermore as an axial extension to a central piston opening 26. This dips into the substance.

With reference to a dispenser head starting position in accordance with FIG. 4, a ventilation opening 29 is formed between the sealing lips 22 of the piston 21 in the area of the pan base 25. This is generally open toward the storage space 3.

A spring 30 impinges the bottom pumping chamber wall 12 in the area of the radial collar 13. The spring 30 is supported on the other end on a pan base 25 of the holder 24; the holder 24 in which the pumping chamber 14 is held in its entirety. The top pumping chamber wall 9 can be led by the circumferential wall of the holder 24. The wall of the holder 24 can provide a stop limitation in interaction with the collar of the top pumping chamber wall 9 at least upwardly to the raised position of the dispenser head.

Via the spring impingement of the bottom pumping chamber wall 12, the top pumping chamber wall 9 is loaded and thereby, the entire dispenser head 5 is loaded in the direction of the raised position. A pumping movement, meaning pressing down the dispenser head 5 to discharge substance, occurs against the force of the spring 30. In accordance with the first embodiment, the spring 30 can be a metal spring, in particular a cylindrical spring.

FIG. 9 shows a second embodiment based on the first embodiment with a plastic spring, for example, manufactured within the scope of a plastic injection-moulding method, which spirally extends from the pan base 25 to the arrangement on the radial collar 13 of the bottom pumping chamber wall 12, thereby surrounding the axis x.

An annulus 31 results, which is open in the direction of the inlet valve 18 between the bottom pumping chamber wall 12 or its bottom tubular section 16 and the pipe section 11.

Figure 6:
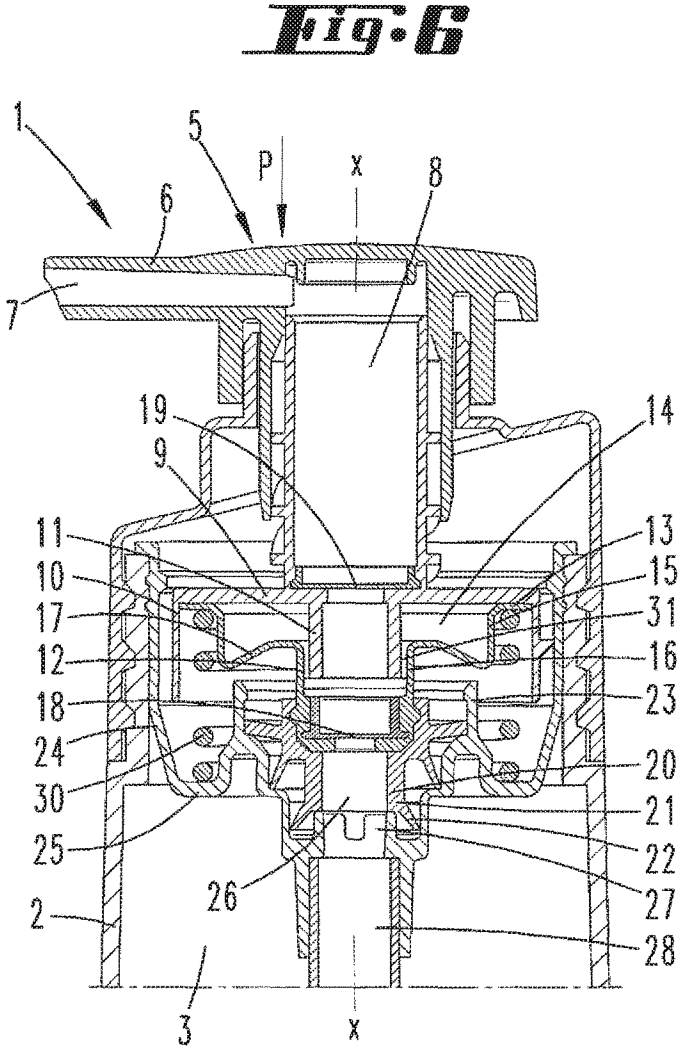
FIG. 6 a longitudinal cross-section illustration shifted by 90° around a dispenser head longitudinal axis with relation to the illustrations in FIGS. 4 and 5, concerning the fully depressed position of the dispenser head.
Figure 4:
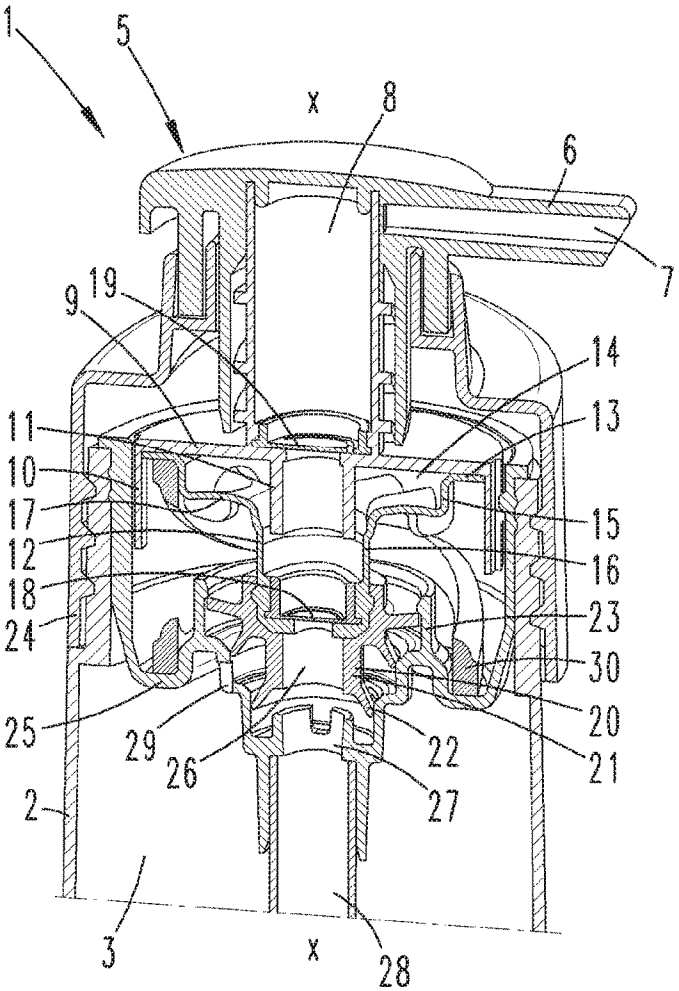
Figure 8:
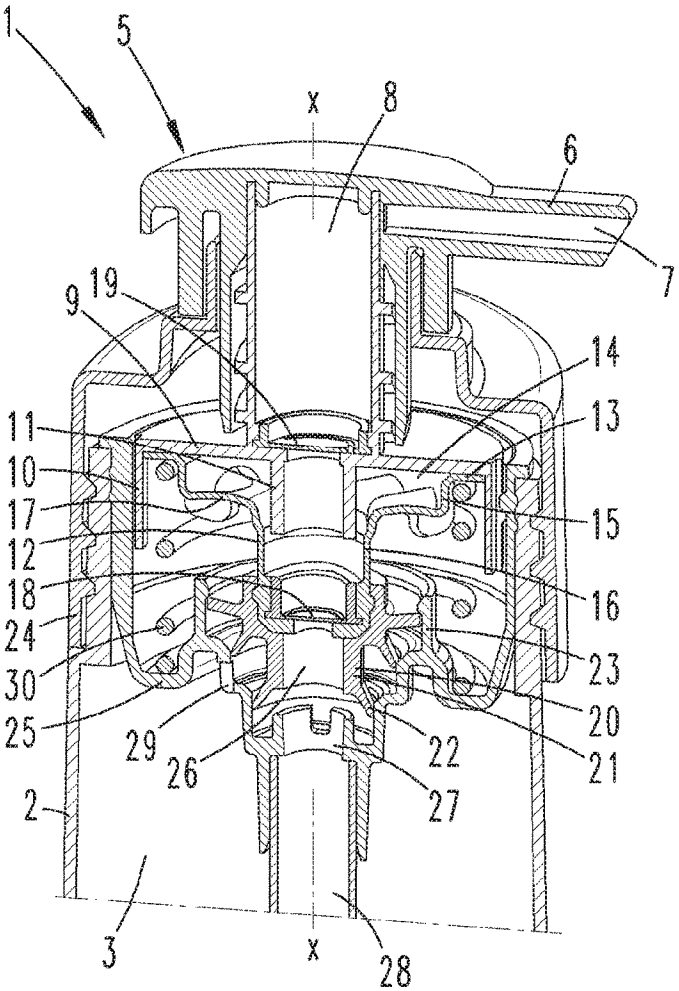
FIG. 8 a prospective longitudinal cross-section illustration of the dispenser head of the first embodiment.

In order to discharge substance from the storage space 3, the dispenser head 5 is brought from a raised position in accordance with FIG. 4 into a depressed position in accordance with FIG. 6. The actuating pressure against the force of the spring 30 required for this is represented by the arrow P.

Figure 5:
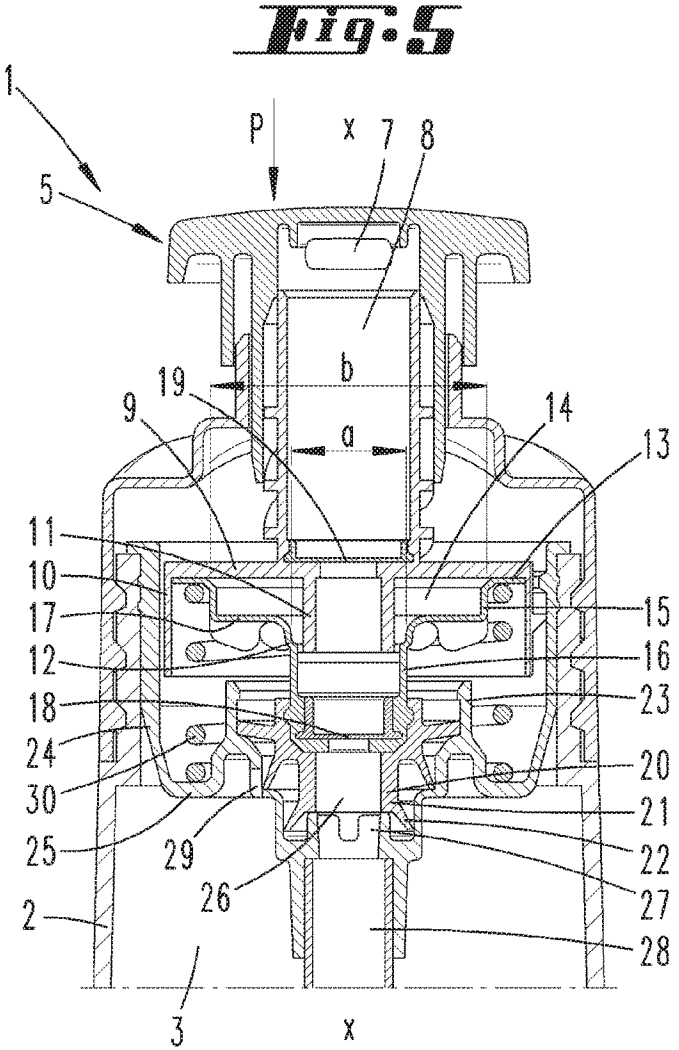
FIG. 5 a subsequent illustration to FIG. 4 within the course of displacing the dispenser head in the direction of a depressed position, concerning an intermediate position.

With an axial displacement of the dispenser head 5 in the direction of the storage container 2, the pumping chamber 14 is initially carried along in an uninfluenced manner until reaching a position in accordance with FIG. 5, in which the piston 21 that is into a fixed position on the bottom pumping chamber wall 12 assumes an end position limited by an end-stop, at which the ventilation opening 29 is released.

As a result of the displacement of a pumping chamber wall 9 and the top tubular section 15 attached to it relative to the fixed bottom tubular section 16 thereby occurring, the other axial displacement of the dispenser head 5 results in the folding section 17 folding inward (cf. FIG. 6). In this position, the radial inner area of the bottom pumping chamber wall 12 is spaced away from the top pumping chamber wall 9 less than an radial outer area.

The discharge of substance occurring can result in an additional effect, since a collapse of the bottom pumping chamber wall 12 can occur only upon the end of the dispenser head displacement and hereby, if applicable, substance can be subsequently discharged again.

The bottom pumping chamber wall 12 can build up an intrinsic elastic restoring force as a result of this folding inward, if applicable, additionally supporting the spring 30.

In the embodiment shown in FIG. 10, where a bag 4 is arranged in the container 2, in particular, the ventilation opening is done without. Accordingly, the closure element 20 and the piston 21 can be done without. In this embodiment, the bottom tubular section 16 of the bottom pumping chamber wall 12 is directly snap-mounted to the pan base 25. By using the downwards displacement of the dispenser head 5 to discharge substance, a relative displacement between the top tubular section 15 and the bottom tubular section 16 of the bottom pumping chamber wall 12 directly occurs.

The aforementioned embodiments serve to explain the inventions recognised by the application overall, which also independently further develop the most recent background art, at least by means of the following feature combinations respectively, namely:

A dispenser 1, characterized in that the bottom pumping chamber wall 12 is joined to the top pumping chamber wall 9 by designing the two walls as a single piece, or by welding or gluing the two walls together, and when the dispenser is actuated, the bottom pumping chamber wall 12 deforms by folding inward such that an elevated region is formed inside in the lateral direction and a lowered region is formed outside in the lateral direction in order for substance to be dispensed.

In order to further improve the dispenser of the kind in question, it is initially and primarily provided that the bottom pumping chamber wall 9 is joined to the top pumping chamber wall by designing the two walls as a single piece, or by welding or gluing the two walls together, and that the pumping chamber walls 9, 12 are made of a plastic material, which has a high degree of barrier density, for example, being made of multiple layers and has a EVOH layer or has a coating, for example, a silicon oxide or silicon dioxide coating and/or, in the case of a design with multiple layers, if only applicable with regard to one or a plurality of layers, consisting of a material such as PET, PBT or PA.

A dispenser 1, characterized in that the pumping chamber 14 has an inlet and outlet valve 18, 19.

A dispenser 1, characterized in that the bottom pumping chamber wall 12 develops an intrinsic elastic restoring force when deforming.

A dispenser 1, characterized in that, if applicable, additionally, a spring 30 is provided that pretensions the bottom pumping chamber wall 12 into an initial position.

A dispenser, characterized in that the inlet and/or outlet valve 18, 19 is manufactured using a second plastic material and is preferably manufactured within the scope of a two-component injection-moulding method.

A dispenser 1, characterized in that the inlet and/or outlet valve 18, 19 in a form-fitting manner within an area formed by a first plastic material.

A dispenser 1, characterized in that the bottom pumping chamber wall 12 has a topside 15 and a bottom-side tubular section 16, wherein the bottom-side tubular section (16) has a lateral extension in a longitudinal cross-section, which is a tenth less or more than a tenth less, all the way to a seventh less than the lateral extension of the topside tubular section 15.

A dispenser 1, characterized in that the tubular sections 15, 17 merge into each other through a folding section 17, which primarily extends only in a lateral manner.

A dispenser 1, characterized in that the bottom tubular section 16 is in any case cylindrical.

A dispenser 1, characterized in that the top pumping chamber wall 9 has a pipe section 11 extending into the pumping chamber 14 against the discharge direction.

A dispenser 1, characterized in that, between the bottom pumping chamber wall 12 and the pipe section 11, there is an annulus that is open in the direction of the inlet valve 18 or a storage space 3.

A dispenser 1, characterized in that the ventilation opening 29 is closed in the raised position and open in the depressed position.

A dispenser 1, characterized in that a ventilation opening 29 of the storage space 3 can be opened and closed by the pumping movement between a depressed and a raised position.

A dispenser 1, characterized in that the ventilation opening 29 is open in the depressed position.

A dispenser 1, characterized in that a closure element for 20 for the ventilation opening 29 is motion-coupled with a bottom pumping chamber wall 12 and/or a holder area of the inlet valve 18.

A dispenser 1, characterized in that the closure element 20 has a piston 21 that has one or a plurality of circumferential sealing lips 22.

A dispenser 1 characterized in that the piston 21 made of a rubber or TPE material is snap-mounted on the outside to the bottom pumping chamber wall 12, preferably to its bottom tubular section 16.

A dispenser 1, characterized in that the dispenser 1 has a pan-like holder 24, in which the pumping chamber 14 is accommodated.

A dispenser 1, characterized in that the piston 21 leads the bottom pumping chamber wall 12 in the holder 24.

All disclosed features (on their own, but also in combination with one another) are essential to the invention. In the disclosure of the application, the disclosure contents of the related/enclosed priority documents (copy of the pre-application) shall hereby be fully included, and also concerning this purpose, features of these documents must be included in claims of the present application. The subclaims with their features characterize further independent inventive embodiments of the most recent prior art, in particular, in order to make divisional applications based on these claims.

LIST OF REFERENCE NUMBERS

1 dispenser
2 storage container
3 storage space
4 bag
5 dispenser head
6 discharge nozzle
7 discharge opening
8 discharge channel
9 top pumping chamber wall
10 collar
11 pipe section
12 bottom pumping chamber wall
13 radial collar
14 pumping chamber
15 top tubular section
16 bottom tubular section
17 folding section
18 inlet valve
19 outlet valve
20 closure element
21 piston
22 sealing lip
23 pan section
24 holder
25 pan base
26 piston opening
27 opening
28 suction pipe
29 ventilation opening
30 spring
31 annulus
a diameter
b diameter
x axis
P arrow

The invention claimed is:

1. A dispenser (1) for liquid to pasty substances, comprising a pumping chamber (14) that has a top pumping chamber wall (9) and a bottom pumping chamber wall (12) in relation to a pumping movement during a vertical pumping movement, the bottom (12) and top pumping chamber walls (9) extending from laterally inside to laterally outside in relation to a geometrical axis (x) running vertically through the center the pumping chamber (14), wherein, furthermore, the bottom pumping chamber wall (12) is joined to the top pumping chamber wall (9) by designing the two walls as a single piece, or by welding or gluing the two walls together and when the dispenser is actuated, the bottom pumping chamber wall (12) deforms by folding inward such that an elevated region is formed inside in the lateral direction and a lower region is formed outside in the lateral direction in order for substance to be dispensed, wherein the top pumping chamber wall (9) has a pipe section (11) formed as a single part with the top pumping chamber wall and extending against the direction of the substance's discharge into the pumping chamber (14) in an extension of a discharge channel (8), an outlet valve being provided for in the transition from the pipe section 11 into the discharge channel 8, and wherein the diameter of this pipe section (11) is adapted to an inner diameter of a bottom tubular section (16) of the bottom pumping chamber wall (12) so that, between the bottom pumping chamber wall (12) and the pipe section (11), an annulus is formed that is open in the direction of an inlet valve or a storage space or is set during the course of a pumping operation.

2. The dispenser (1) according to claim 1, wherein the bottom pumping chamber wall (12) develops an intrinsic elastic restoring force when deforming.

3. The dispenser (1) according to claim 1, wherein a spring (30) pretensioning the bottom pumping chamber wall (12) into an initial position is provided.

4. The dispenser (1) according to claim 1, wherein the inlet (18) and/or outlet valve (19) is manufactured using a second plastic material and is manufactured within the scope of a two-component injection-moulding method.

5. The dispenser (1) according to claim 4, wherein the inlet (18) and/or outlet valve (19) is accommodated in a form-fitting manner within an area made by means of a first plastic material.

6. The dispenser (1) according to claim 1, wherein the bottom pumping chamber wall (12) has a topside (15) and a bottom-side tubular section (16), wherein the bottom-side tubular section (16) has a lateral extension in a longitudinal cross-section, which is a tenth less or more than a tenth less, all the way to a seventh less than the lateral extension of the topside tubular section (15).

7. The dispenser (1) according to claim 6, wherein the tubular sections (15, 16) merge into each other via a folding section (17), which primarily extends only in a lateral manner.

8. The dispenser (1) according to claim 6, wherein the bottom tubular section (16) is, in any case, cylindrical.

9. The dispenser (1) according to claim 1, wherein, between the bottom pumping chamber wall (12) and the pipe section (11), the annulus (31) is open in the direction of the inlet valve (18) or the storage space (3).

* * * * *